US007345656B2

(12) United States Patent
Chen et al.

(10) Patent No.: US 7,345,656 B2
(45) Date of Patent: Mar. 18, 2008

(54) DRIVING CIRCUIT OF PLASMA DISPLAY PANEL

(75) Inventors: Bi-Hsien Chen, Ping-Tung Hsien (TW); Yi-Min Huang, Taipei (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 142 days.

(21) Appl. No.: 11/425,693

(22) Filed: Jun. 21, 2006

(65) Prior Publication Data

US 2006/0290605 A1 Dec. 28, 2006

Related U.S. Application Data

(60) Provisional application No. 60/595,301, filed on Jun. 22, 2005.

(51) Int. Cl.
*G09G 3/28* (2006.01)

(52) U.S. Cl. ..... 345/66; 345/63

(58) Field of Classification Search ..... 345/37, 345/41, 42, 60, 63, 66; 315/169.3, 169.4; 313/567

See application file for complete search history.

(56) References Cited

U.S. PATENT DOCUMENTS 6,628,275 B2 * 9/2003 Vossen et al. ..... 345/211
6,680,581 B2 * 1/2004 Lee et al. ..... 315/169.3
6,768,270 B2 * 7/2004 Chae ..... 315/169.3
6,781,322 B2 * 8/2004 Onozawa et al. ..... 315/169.3
6,933,679 B2 * 8/2005 Lee et al. ..... 315/169.4
6,961,031 B2 * 11/2005 Lee et al. ..... 345/60
7,023,139 B2 * 4/2006 Lee et al. ..... 315/169.1
7,027,010 B2 * 4/2006 Lee ..... 345/60
7,123,219 B2 * 10/2006 Lee ..... 345/76
7,176,854 B2 * 2/2007 Lee et al. ..... 345/60
2003/0173905 A1 * 9/2003 Lee et al. ..... 315/169.3
2003/0193454 A1 * 10/2003 Lee et al. ..... 345/63
2004/0012546 A1 * 1/2004 Takagi et al. ..... 345/60
2004/0135746 A1 * 7/2004 Lee et al. ..... 345/60
2006/0238447 A1 * 10/2006 Chen ..... 345/60
2006/0267874 A1 * 11/2006 Chen et al. ..... 345/68

* cited by examiner

*Primary Examiner*—Ricardo Osorio
(74) *Attorney, Agent, or Firm*—Winston Hsu

(57) ABSTRACT

A plasma display panel driving circuit includes a panel capacitor having a first side and a second side, a first switch electrically connected between the first side of the panel capacitor and a first voltage, a second switch electrically connected between the second side of the panel capacitor and the first voltage, a first inductor and a first diode electrically connected in series between the first side of the panel capacitor and a first node, a second inductor and a second diode electrically connected in series between the second side of the panel capacitor and the first node, a third switch electrically connected between the first side of the panel capacitor and the first node, a fourth switch electrically connected between the second side of the panel capacitor and the first node, and a fifth switch electrically connected between the first node and a second voltage.

14 Claims, 6 Drawing Sheets

DRIVING CIRCUIT OF PLASMA DISPLAY PANEL

CROSS REFERENCE TO RELATED APPLICATIONS

This application claims the benefit of the filing date of U.S. provisional patent application No. 60/595,301, filed Jun. 22, 2005, the contents of which are hereby incorporated by reference.

BACKGROUND OF THE INVENTION

1. Field of the Invention

The present invention relates to a driving circuit, and more specifically, to a driving circuit for a plasma display panel (PDP).

2. Description of the Prior Art

In a plasma display panel (PDP), charges are accumulated on the electrodes of cells according to display data, and a sustaining discharge pulse is applied to paired electrodes of the cells in order to generate visible light. As far as the PDP display is concerned, a high voltage is required to be applied to the electrodes, and a pulse-duration of several microseconds is usually required. There are many sustaining pulses to apply to electrodes. Hence the power consumption of a PDP display is considerable. When energy can be recovered from the panel, the power consumption of the panel will be reduced. Many designs and patents have been developed for providing methods and apparatuses for energy recovery in PDPs.

Please refer to FIG. 1 which illustrates a circuit diagram of a PDP driving circuit 100 according to the prior art. The PDP driving circuit 100 comprises an equivalent panel capacitor Cp having an X side and a Y side, four switches S1 to S4 for permitting current to pass as part of a voltage clamp circuit, and a charging/discharging circuit that includes two switches S5 and S6 with body diodes, two diodes D1 and D2, and an inductor L1. The PDP driving circuit 100 requires the two switches S5 and S6 in order to allow two-direction discharge, which is required for energy recovery. That is, the two switches S5 and S6 achieve two paths that allow ineffective power from the X side of the panel capacitor Cp to be recovered to the Y side and vice versa.

In operation, the switches S1 to S6 are controlled to provide panel capacitor Cp voltages as shown in FIG. 2. In plot 204, the individual voltages of the X side (dashed line) and Y side (solid line) of the panel capacitor Cp are shown to vary between 0 and Vs. Plot 202 shows the voltage across the panel capacitor Cp, which is the voltage of the Y side minus the voltage of the X side. The voltage across the panel capacitor Cp varies between Vs and −Vs.

The prior art requires six switches S1 to S6, thereby increasing the space required on a semiconductor integrated circuit.

SUMMARY OF THE INVENTION

It is therefore an objective of the invention to provide a plasma display panel driving circuit that solves the problems of the prior art.

Briefly summarized, the claimed plasma display panel driving circuit includes a panel capacitor having a first side and a second side, a first switch electrically connected between the first side of the panel capacitor and a first voltage, a second switch electrically connected between the second side of the panel capacitor and the first voltage, a first inductor and a first diode electrically connected in series between the first side of the panel capacitor and a first node, a second inductor and a second diode electrically connected in series between the second side of the panel capacitor and the first node, a third switch electrically connected between the first side of the panel capacitor and the first node, a fourth switch electrically connected between the second side of the panel capacitor and the first node, and a fifth switch electrically connected between the first node and a second voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
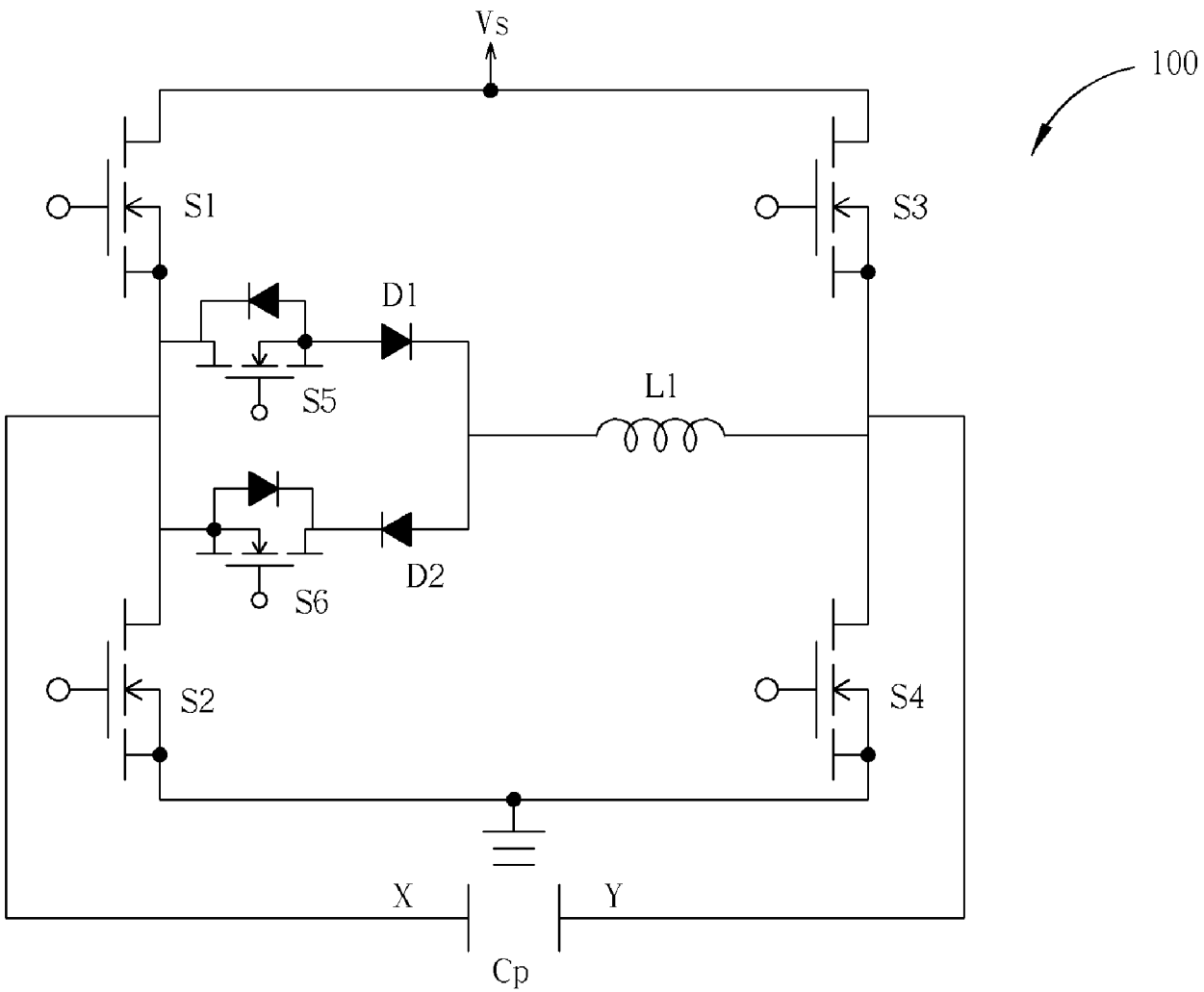
Fig. 1 Prior Art
FIG. 1 is a circuit diagram of a plasma display panel driving circuit according to the prior art.
Figure 2:
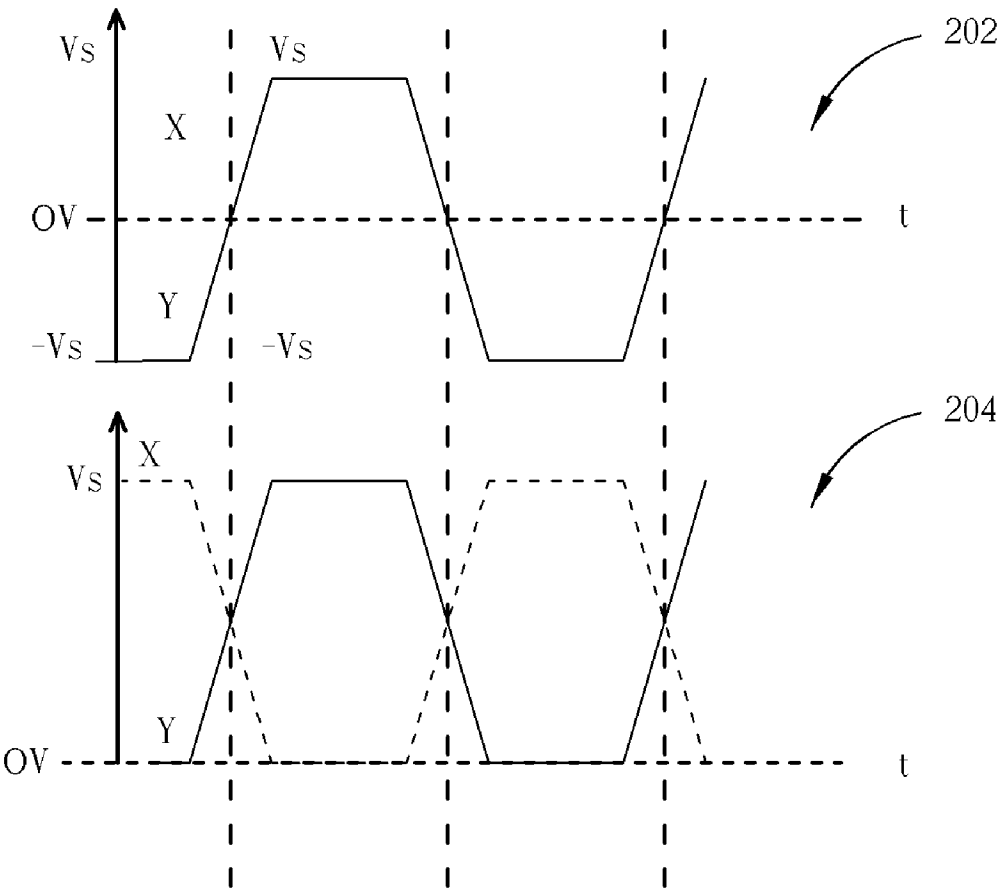
Fig. 2 Prior Art
FIG. 2 shows voltage levels in the circuit of FIG. 1.
Figure 3:
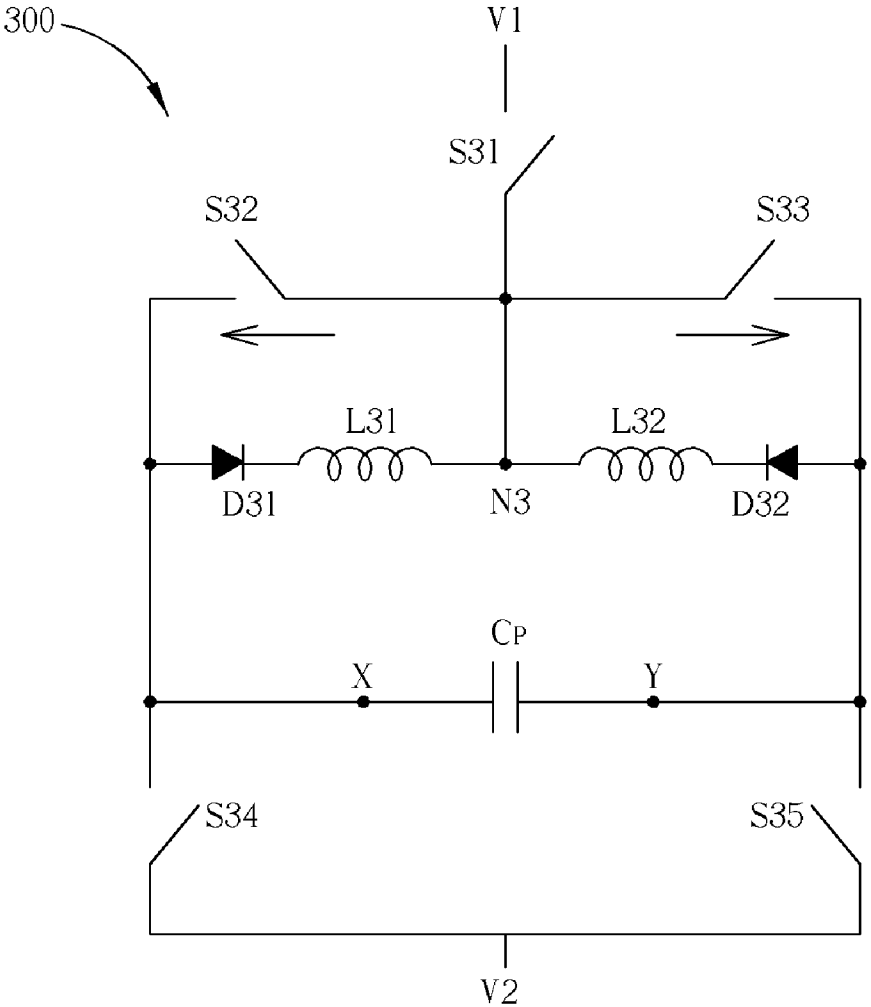
FIG. 3 is a circuit diagram of a plasma display panel driving circuit according to a first embodiment of the present invention.

The present invention provides a new driving circuit for the PDP. Please refer to FIG. 3. FIG. 3 is a circuit diagram of a plasma display panel driving circuit 300 according to a first embodiment of the present invention. The driving circuit 300 comprises five switches S31, S32, S33, S34, and S35, two diodes D31 and D32, and two inductors L31 and L32, coupled to an equivalent panel capacitor Cp of a plasma display panel. The driving circuit 300 is electrically connected to a voltage source V1, wherein the voltage potential output by voltage source V1 is greater than the voltage potential output by voltage source V2. The voltage V1 is a positive voltage, whereas the voltage V2 can be ground or a negative voltage.

The switch S31 is electrically connected between the voltage source V1 and node N3. Switches S32 and S33 are unidirectional switches, as indicated by the arrows shown in FIG. 3. Switch S32 is electrically connected between the node N3 and an X side of the panel capacitor Cp, wherein current flows in the direction toward the X side of the panel capacitor Cp. Switch S33 is electrically connected between the node N3 and a Y side of the panel capacitor Cp, wherein current flows in the direction toward the Y side of the panel capacitor Cp. Diode D31 and inductor L31 are electrically connected in series between the X side of the panel capacitor Cp and the node N3, where an anode of diode D31 is electrically connected to the X side of the panel capacitor Cp and the inductor L31 is electrically connected between a cathode of the diode D31 and the node N3. Likewise, diode D32 and inductor L32 are electrically connected in series between the Y side of the panel capacitor Cp and the node N3, where an anode of diode D32 is electrically connected to the Y side of the panel capacitor Cp and the inductor L32 is electrically connected between a cathode of the diode D32 and the node N3. Switch S34 is electrically connected between the X side of the panel capacitor Cp and voltage source V2, whereas switch S35 is electrically connected between the Y side of the panel capacitor Cp and V2. The switches S31 to S35 can be N-type or P-type metal oxide semiconductor (MOS) transistors, other types of transistors, or other switching devices. One advantage of the driving circuit 300 is that the rising and falling slopes of the sustain waveform can be different from each other and can be adjusted by adjusting the inductance of the inductors L31 and L32. Moreover, the five switches S31 to S35 is one fewer than the six switches S1 to S6 of the prior art driving circuit 100.

Figure 4:
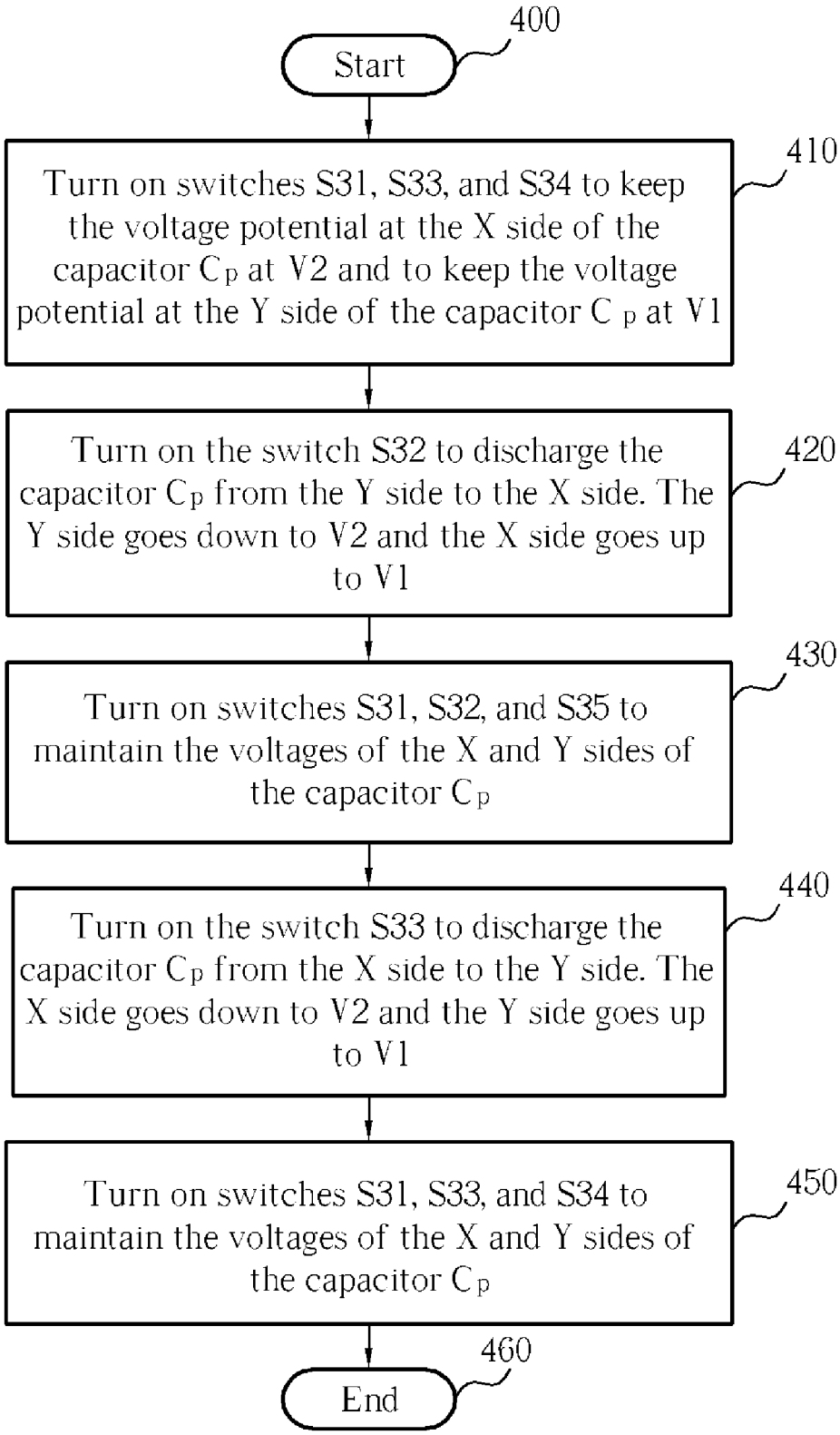
FIG. 4 is a flowchart illustrating the operation of the driving circuit of the first embodiment for creating a sustain waveform.

Please refer to FIG. 4, which illustrates the operation of the driving circuit 300 of the first embodiment for creating a sustain waveform. Steps contained in the flowchart will be explained as follows.

Step 400: Start.

Step 410: Keep the voltage potential at the X side of the panel capacitor Cp at V2 by turning on the switch S34. Keep the voltage potential at the Y side of the panel capacitor Cp at V1 by turning on the switches S31 and S33, where the current path is through S31 and S33.

Step 420: Discharge the panel capacitor Cp from the Y side to the X side by turning on the switch S32. The voltage potential at the X side of the panel capacitor Cp goes up to V1 and the voltage potential at the Y side of the panel capacitor Cp goes down to V2 accordingly, and the current path is through D32, L32, and S32.

Step 430: Keep the voltage potential at the X side of the panel capacitor Cp at V1 by turning on the switches S31 and S32, where the current path is through S31 and S32. Keep the voltage potential at the Y side of the panel capacitor Cp at V2 by turning on the switch S35.

Step 440: Discharge the panel capacitor Cp from the X side to the Y side by turning on the switch S33. The voltage potential at the X side of the panel capacitor Cp goes down to V2 and the voltage potential at the Y side of the panel capacitor Cp goes up to V1 accordingly, and the current path is through D31, L31, and S33.

Step 450: Keep the voltage potential at X side of the panel capacitor Cp at V2 by turning on the switch S34. Keep the voltage potential at Y side of the panel capacitor Cp at V1 by turning on the switches S31 and S33, where the current path is through S31 and S33.

Step 460: End.

Figure 5:
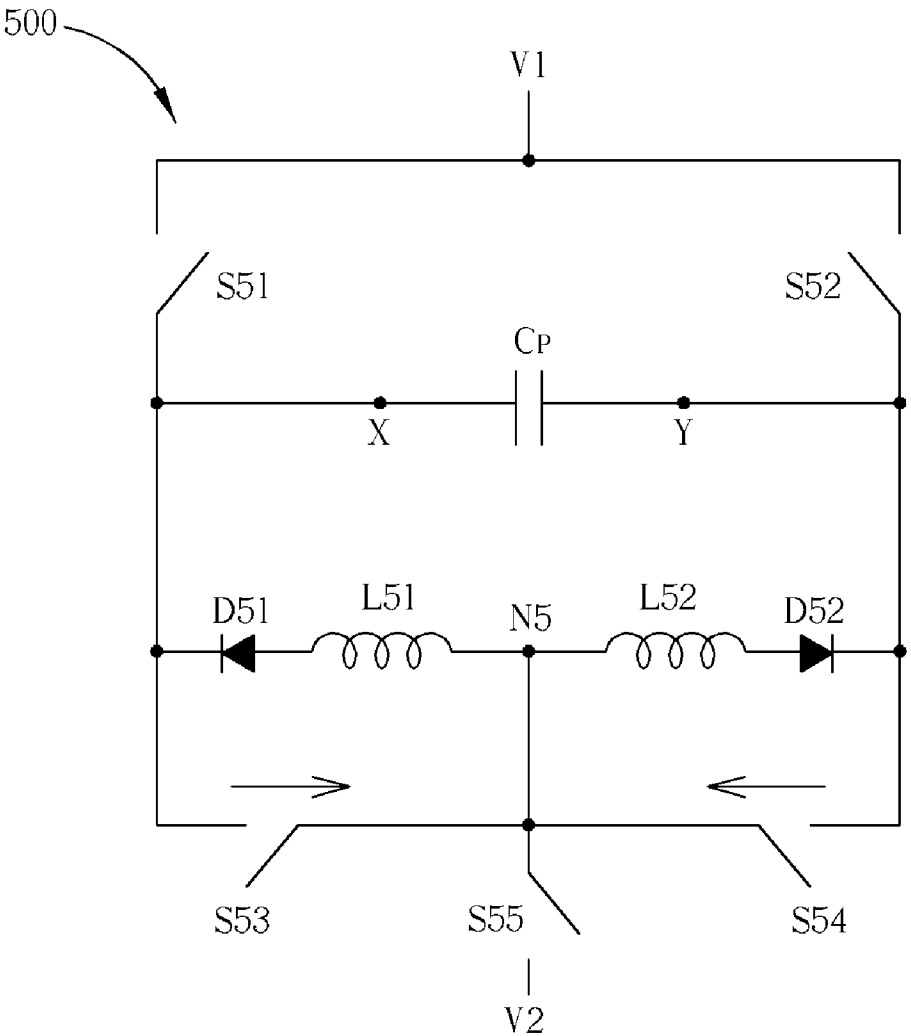
FIG. 5 is a circuit diagram of a plasma display panel driving circuit according to a second embodiment of the present invention.

Please refer to FIG. 5. FIG. 5 is a circuit diagram of a plasma display panel driving circuit 500 according to a first embodiment of the present invention. The driving circuit 500 comprises five switches S51, S52, S53, S54, and S55, two diodes D51 and D52, and two inductors L51 and L52, coupled to an equivalent panel capacitor Cp of a plasma display panel. The driving circuit 500 is electrically connected to a voltage source V1, wherein the voltage potential output by voltage source V1 is greater than the voltage potential output by voltage source V2. The voltage V1 is a positive voltage, whereas the voltage V2 can be ground or a negative voltage.

Switch S51 is electrically connected between an X side of the panel capacitor Cp and the voltage source V1, whereas switch S52 is electrically connected between a Y side of the panel capacitor Cp and the voltage source V1. Diode D51 and inductor L51 are electrically connected in series between the X side of the panel capacitor Cp and node N5, where a cathode of diode D51 is electrically connected to the X side of the panel capacitor Cp and the inductor L51 is electrically connected between an anode of the diode D51 and the node N5. Likewise, diode D52 and inductor L52 are electrically connected in series between the Y side of the panel capacitor Cp and the node N5, where a cathode of diode D52 is electrically connected to the Y side of the panel capacitor Cp and the inductor L52 is electrically connected between an anode of the diode D52 and the node N5. Switches S53 and S54 are unidirectional switches, as indicated by the arrows shown in FIG. 5. Switch S53 is electrically connected between the node N5 and the X side of the panel capacitor Cp, wherein current flows in the direction away from the X side of the panel capacitor Cp. Switch S54 is electrically connected between the node N5 and the Y side of the panel capacitor Cp, wherein current flows in the direction away from the Y side of the panel capacitor Cp. The switch S55 is electrically connected between the node N5 and V2. As with the driving circuit 300, a property of the driving circuit 500 is that the rising and falling slopes of the sustain waveform can be different from each other and can be adjusted by adjusting the inductance of the inductors L51 and L52. Moreover, the five switches S51 to S55 is one fewer than the six switches S1 to S6 of the prior art driving circuit 100.

Figure 6:
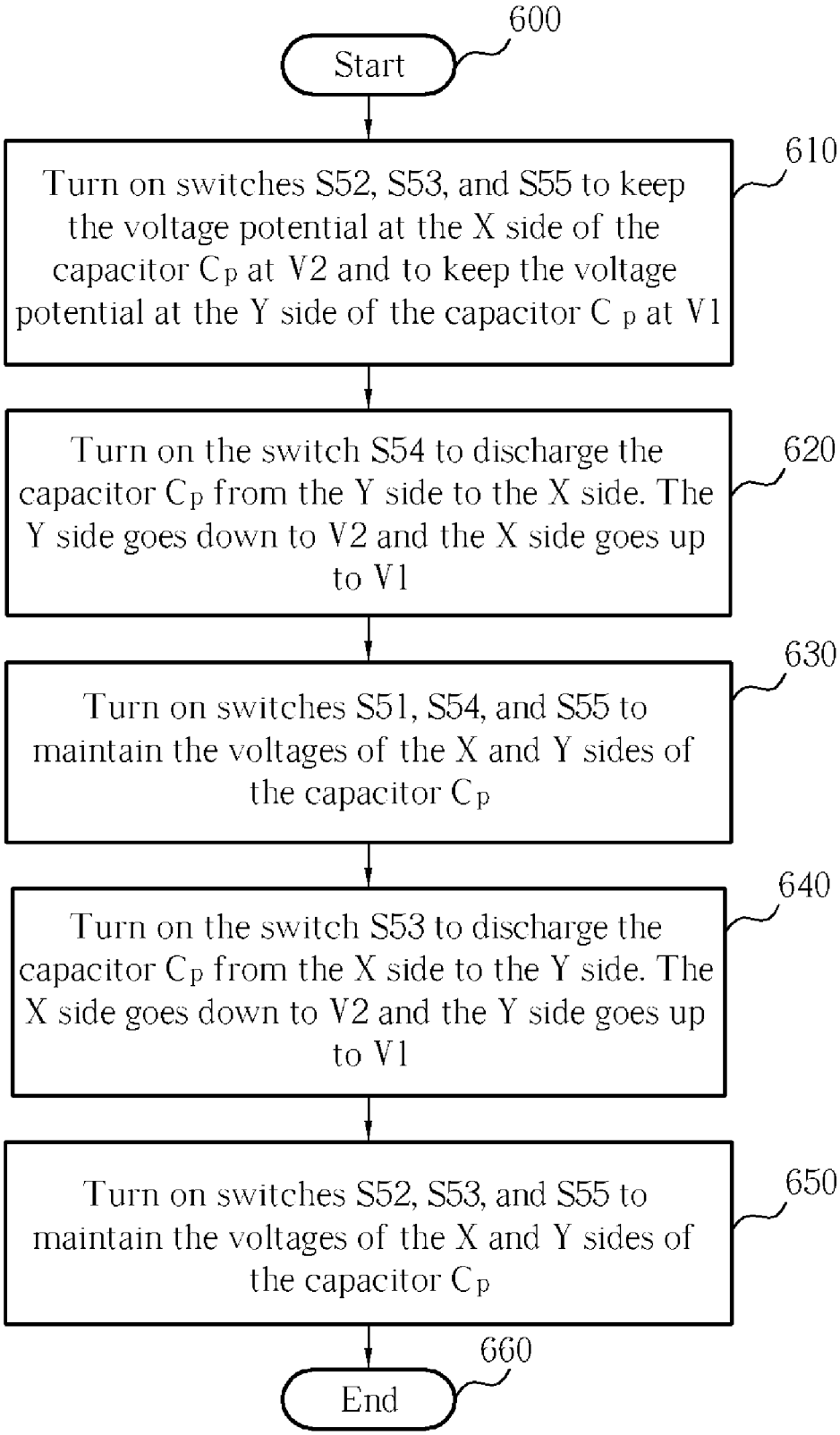
FIG. 6 is a flowchart illustrating the operation of the driving circuit of the second embodiment for creating a sustain waveform.

Please refer to FIG. 6, which illustrates the operation of the driving circuit 500 of the first embodiment for creating a sustain waveform. Steps contained in the flowchart will be explained as follows.

Step 600: Start.

Step 610: Keep the voltage potential at the X side of the panel capacitor Cp at V2 by turning on the switches S53 and S55, where the current path is through S53 and S55. Keep the voltage potential at the Y side of the panel capacitor Cp at V1 by turning on the switch S52.

Step 620: Discharge the panel capacitor Cp from the Y side to the X side by turning on the switch S54. The voltage potential at the X side of the panel capacitor Cp goes up to V1 and the voltage potential at the Y side of the panel capacitor Cp goes down to V2 accordingly, and the current path is through S54, L51, and D51.

Step 630: Keep the voltage potential at the X side of the panel capacitor Cp at V1 by turning on the switch S51. Keep the voltage potential at the Y side of the panel capacitor Cp at V2 by turning on the switches S54 and S55, where the current path is through S54 and S55.

Step 640: Discharge the panel capacitor Cp from the X side to the Y side by turning on the switch S53. The voltage potential at the X side of the panel capacitor Cp goes down to V2 and the voltage potential at the Y side of the panel capacitor Cp goes up to V1 accordingly, and the current path is through S53, L52, and D52.

Step 650: Keep the voltage potential at the X side of the panel capacitor Cp at V2 by turning on the switches S53 and S55, where the current path is through S53, D51, and S55. Keep the voltage potential at the Y side of the panel capacitor Cp at V1 by turning on the switch S52.

Step 660: End.

In summary, the present invention provides embodiments of driving circuits that utilize fewer switches than the prior art driving circuit. Only five switches are required instead of six switches. Therefore, use of the present invention driving circuits reduces the space required on a semiconductor integrated circuit. In addition, the rising and falling slopes of the sustain waveform can be different from each other and can be adjusted by adjusting the inductance of the two inductors.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A plasma display panel driving circuit comprising:

a panel capacitor having a first side and a second side;

a first switch electrically connected between the first side of the panel capacitor and a first voltage;

a second switch electrically connected between the second side of the panel capacitor and the first voltage;

a first inductor and a first diode electrically connected in series between the first side of the panel capacitor and a first node;

a second inductor and a second diode electrically connected in series between the second side of the panel capacitor and the first node;

a third switch electrically connected between the first side of the panel capacitor and the first node;

a fourth switch electrically connected between the second side of the panel capacitor and the first node; and a fifth switch electrically connected between the first node and a second voltage.

2. The plasma display panel driving circuit of claim 1, wherein the first voltage is greater than the second voltage.

3. The plasma display panel driving circuit of claim 2, wherein a cathode of the first diode is electrically connected to the first side of the panel capacitor, the first inductor is electrically connected between an anode of the first diode and the first node, a cathode of the second diode is electrically connected to the second side of the panel capacitor, and the second inductor is electrically connected between an anode of the second diode and the first node.

4. The plasma display panel driving circuit of claim 2, wherein the first voltage is supplied by a positive voltage source and the second voltage is ground.

5. The plasma display panel driving circuit of claim 2, wherein the first voltage is supplied by a positive voltage source and the second voltage is supplied by a negative voltage source.

6. The plasma display panel driving circuit of claim 2, wherein the third switch and the fourth switch are unidirectional switches.

7. The plasma display panel driving circuit of claim 6, wherein current only passes through the third switch away from the first side of the panel capacitor, and current only passes through the fourth switch away from the second side of the panel capacitor.

8. The plasma display panel driving circuit of claim 1, wherein the first voltage is less than the second voltage.

9. The plasma display panel driving circuit of claim 8, wherein an anode of the first diode is electrically connected to the first side of the panel capacitor, the first inductor is electrically connected between a cathode of the first diode and the first node, an anode of the second diode is electrically connected to the second side of the panel capacitor, and the second inductor is electrically connected between a cathode of the second diode and the first node.

10. The plasma display panel driving circuit of claim 8, wherein the first voltage is ground and the second voltage is supplied by a positive voltage source.

11. The plasma display panel driving circuit of claim 8, wherein the first voltage is supplied by a negative voltage source and the second voltage is supplied by a positive voltage source.

12. The plasma display panel driving circuit of claim 8, wherein the third switch and the fourth switch are unidirectional switches.

13. The plasma display panel driving circuit of claim 12, wherein current only passes through the third switch toward the first side of the panel capacitor, and current only passes through the fourth switch toward the second side of the panel capacitor.

14. The plasma display panel driving circuit of claim 1, wherein the first, second, third, fourth, and fifth switches are transistors.

* * * * *